US006652420B2

(12) United States Patent
Chen

(10) Patent No.: US 6,652,420 B2
(45) Date of Patent: Nov. 25, 2003

(54) GRIP STRUCTURE OF EXERCISE DEVICE

(76) Inventor: James Chen, No. 35, Tun Hi Rd., Chin Chan Li, Sa Lu Chen, Taichung Hsien (TW)

( * ) Notice: Subject to any disclaimer, the term of this patent is extended or adjusted under 35 U.S.C. 154(b) by 279 days.

(21) Appl. No.: 09/924,091

(22) Filed: Aug. 8, 2001

(65) Prior Publication Data

US 2003/0032526 A1 Feb. 13, 2003

(51) Int. Cl.[7] ..... A63B 21/00; A63B 23/14
(52) U.S. Cl. ..... 482/45; 482/139
(58) Field of Search ..... 482/45, 46, 102, 482/103, 106, 139, 908

(56) References Cited

U.S. PATENT DOCUMENTS 1,333,005 A * 3/1920 Warner ..... 482/110
2,172,121 A * 9/1939 Buchanan ..... 74/557
3,384,370 A * 5/1968 Bailey et al. ..... 482/106
4,585,229 A * 4/1986 Brasher ..... 482/106
4,618,143 A * 10/1986 Twardosz ..... 482/106
4,690,400 A * 9/1987 Metz ..... 482/106
4,770,409 A * 9/1988 Wallisch ..... 482/45
4,822,035 A * 4/1989 Jennings et al. ..... 482/106
5,344,374 A * 9/1994 Telle ..... 482/97
5,407,405 A * 4/1995 Oren ..... 482/50
5,718,654 A * 2/1998 Kennedy ..... 482/139
6,244,999 B1 * 6/2001 Alessandri ..... 482/142
6,264,589 B1 * 7/2001 Chen ..... 482/139

* cited by examiner

*Primary Examiner*—Nicholas D. Lucchesi
*Assistant Examiner*—Victor Hwang
(74) *Attorney, Agent, or Firm*—Browdy and Neimark, P.L.L.C.

(57) ABSTRACT

A grip structure is designed for use in an exercise device and is formed of a main body, a grip rod, and two slide blocks disposed at two ends of the grip rod. The main body is of a ring-shaped construction and is provided with a groove. The main body is fastened with a predetermined portion of the operation rod of the exercise device. The slide blocks are slidably received in the groove of the main body. The grip rod can be adjusted 360 degrees in relation to the main body, thereby enabling a change in direction in which the grip rod is held fast by an exerciser.

4 Claims, 5 Drawing Sheets

GRIP STRUCTURE OF EXERCISE DEVICE

FIELD OF THE INVENTION

The present invention relates generally to an exercise device, and more particularly to a grip structure of the exercise device.

BACKGROUND OF THE INVENTION

There are a variety of exercise devices calling for the use of both hands of an exerciser for building the body muscles. The grip portion is intended to be held by hand of the exerciser and is generally fixed at a position of the handle such that the grip portion can not be adjusted in position to facilitate the training of the upper half body of the exerciser. As a result, the exerciser must resort to an improper posture which works against the mechanics of the human body. This inventor of the present invention discloses a grip structure comprising a grip portion changeable in direction in which the grip portion is disposed. The grip portion is adapted to be held in various ways for building the muscles of various parts of an exerciser's body. However, this grip structure is complicated in construction and is not cost-effective.

SUMMARY OF THE INVENTION

The primary objective of the present invention is to provide an exercise device with a grip structure which is simple in construction and is provided with a grip portion which can be changed in direction in which a force is exerted for the purpose of building muscles of various parts of a human body.

The present invention comprises a main body and a grip member. The main body is disposed in a predetermined portion of an operation rod of an exercise device and is of a ring-shaped construction. The main body has an outer ring portion, an inner ring portion, and a groove extending along the inner ring portion. The grip member comprises a grip rod and two slide blocks which are disposed at two ends of the grip rod. The grip rod is intended for holding fast with hand. The slide blocks move along the groove. The grip rod can be adjusted in the range of 360 degrees in the main body, thereby resulting in a change in direction in which the grip rod is held fast.

DETAILED DESCRIPTION OF THE INVENTION

Figure 1:
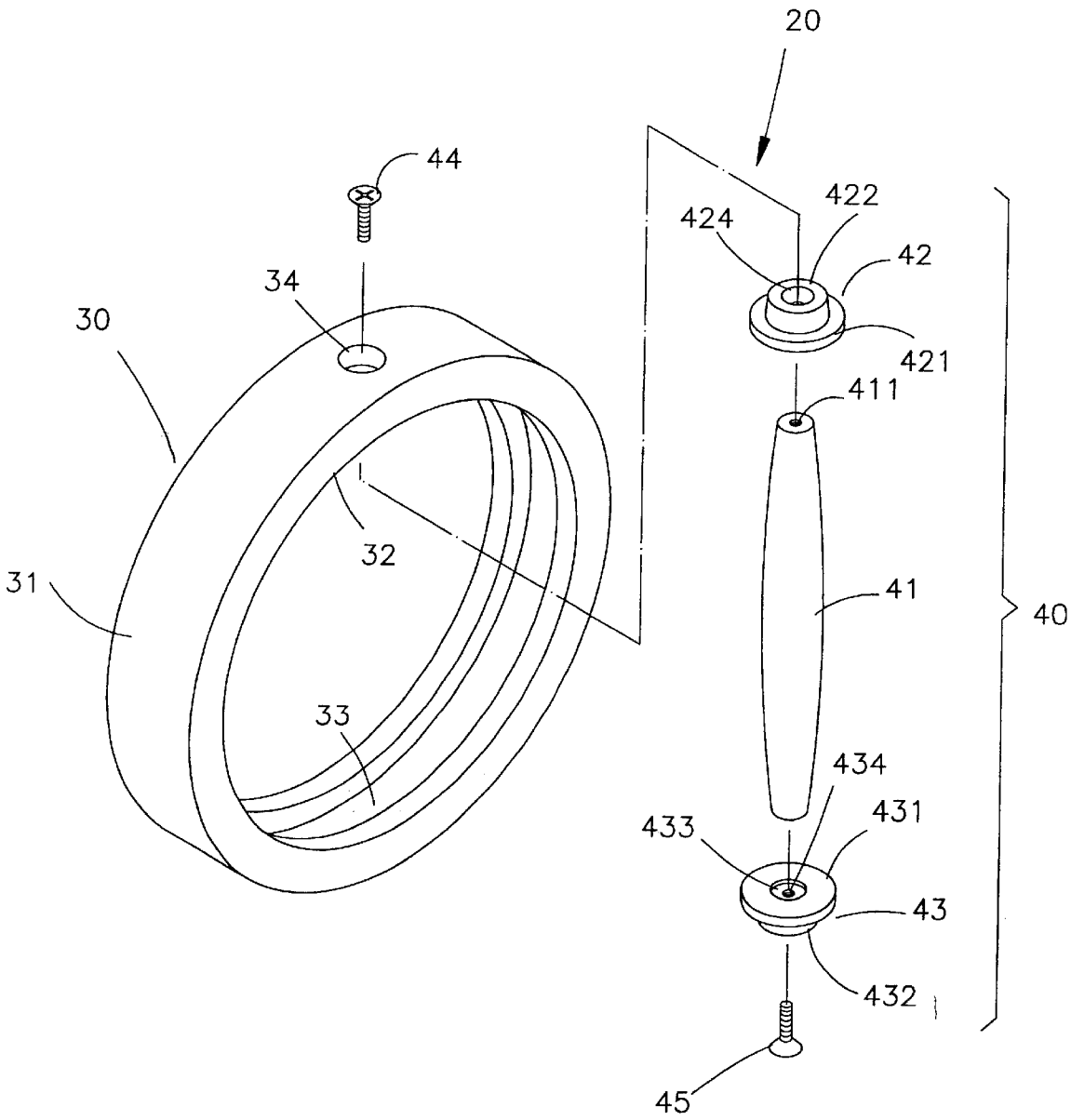
FIG. 1 shows an exploded view of a preferred embodiment of the present invention.
Figure 2:
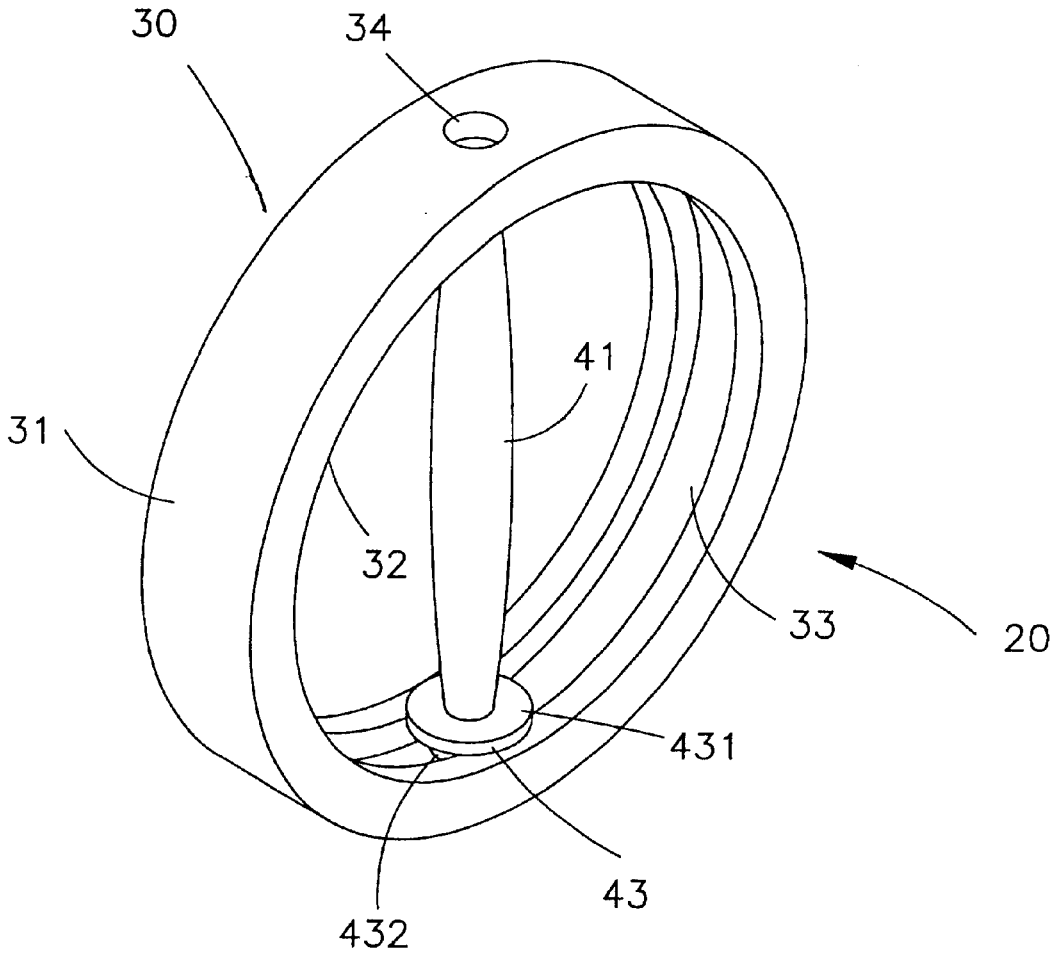
FIG. 2 shows a perspective view of the preferred embodiment of the present invention.

As shown in FIGS. 1–4, a grip structure 20 embodied in the present invention is disposed on an application portion of operation rod of an exercise device and is formed of a main body 30 and a grip member 40.

The main body 30 is of a ring-shaped construction having a predetermined diameter. The main body 30 has an outer ring portion 31 and an inner ring portion 32. A groove 33 of a predetermined depth is disposed along the inner ring portion 32 such that the groove 33 is in communication with a through hole 34 extending from the outer ring portion 31 through the inner ring portion 32.

The grip member 40 comprises a grip rod 41 and two slide blocks 42 and 43, which are disposed at two ends of the grip rod 41.

The grip rod 41 is of a columnar construction and has two ends smaller in diameter and having respectively an inner threaded hole 411, 412.

The slide blocks 42 and 43 are of an inverted T-shaped construction and are provided respectively with a circular stop portion 421, 431, and a slide portion 422, 432. The circular stop portions 421 and 431 are circular disk bodies with a diameter greater than the width of the groove 33 of the main body 30 and corresponding in radian to the inner ring portion 32. The circular stop portion 421, 431 is provided in the bottom with an inner recess hole 423, 433 with a diameter corresponding to the diameter of the end of the grip rod 41 for connecting the grip rod 41.

The slide portion 422, 432 is a round columnar body extending from the center of the circular stop portion 421, 431 and having a diameter corresponding to the width of the groove 33 of the main body 30 for inserting slidably into the groove 33. The slide blocks 42 and 43 are provided at the center with a threaded hole 424, 434 corresponding to the inner threaded hole 411, 412 for engaging two bolt elements 44 and 45 to connect the slide blocks 42 and 43 with the grip rod 41. The bolt elements 44 and 45 are preferably sunken screws. The threaded holes 424 and 434 are preferably sunk holes to prevent the bolt elements 44 and 45 from jutting out of the slide portions 42 and 43 to affect the sliding of the slide portions 42 and 43.

Figure 3:
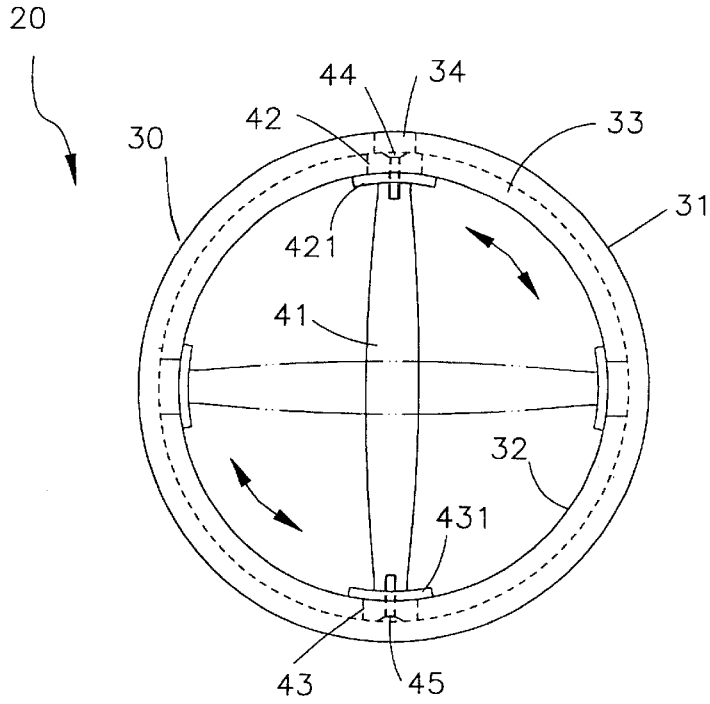
FIG. 3 shows a schematic plan view of the preferred embodiment of the present invention in combination.
Figure 4:
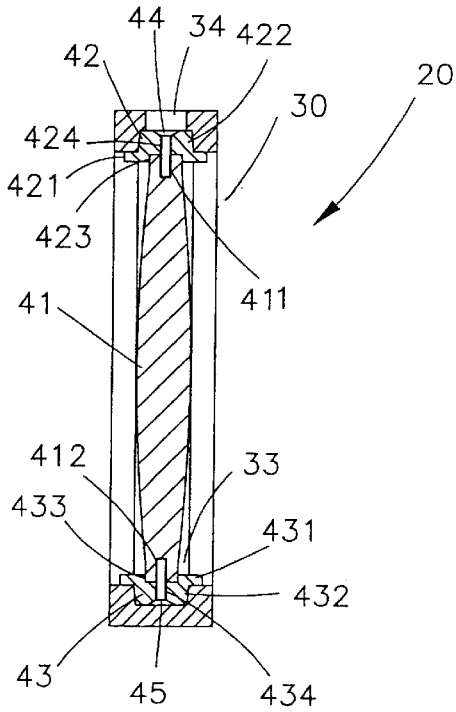
FIG. 4 shows a sectional schematic view of the preferred embodiment of the present invention in combination.

As shown in FIGS. 3 and 4, two ends of the grip rod 41 are first inserted into the inner recess holes 423 and 433 of the slide blocks 42 and 43 such that the slide portions 422 and 432 of the slide blocks 42 and 43 are inserted into the groove 33 of the main body 30, and that the circular stop portions 421 and 431 of the slide blocks 42 and 43 are stopped on the groove 33 and are attached to the inner ring portion 32 of the main body 30. The inner threaded hole 424 of the slide block 42 is aligned with the through hole 34 of the main body 30. A bolt element 44 is inserted into the through hole 34 to engage the threaded hole 424 of the slide block 42 and the inner threaded hole 411 of the grip rod 41. Thereafter, the grip rod 41 is turned such that the inner threaded hole 434 of the slide block 43 is aligned with the through hole 34 of the main body 30. Similarly, a bolt element 45 is put into the through hole 34 to complete the fastening of the grip rod 41.

Figure 5:
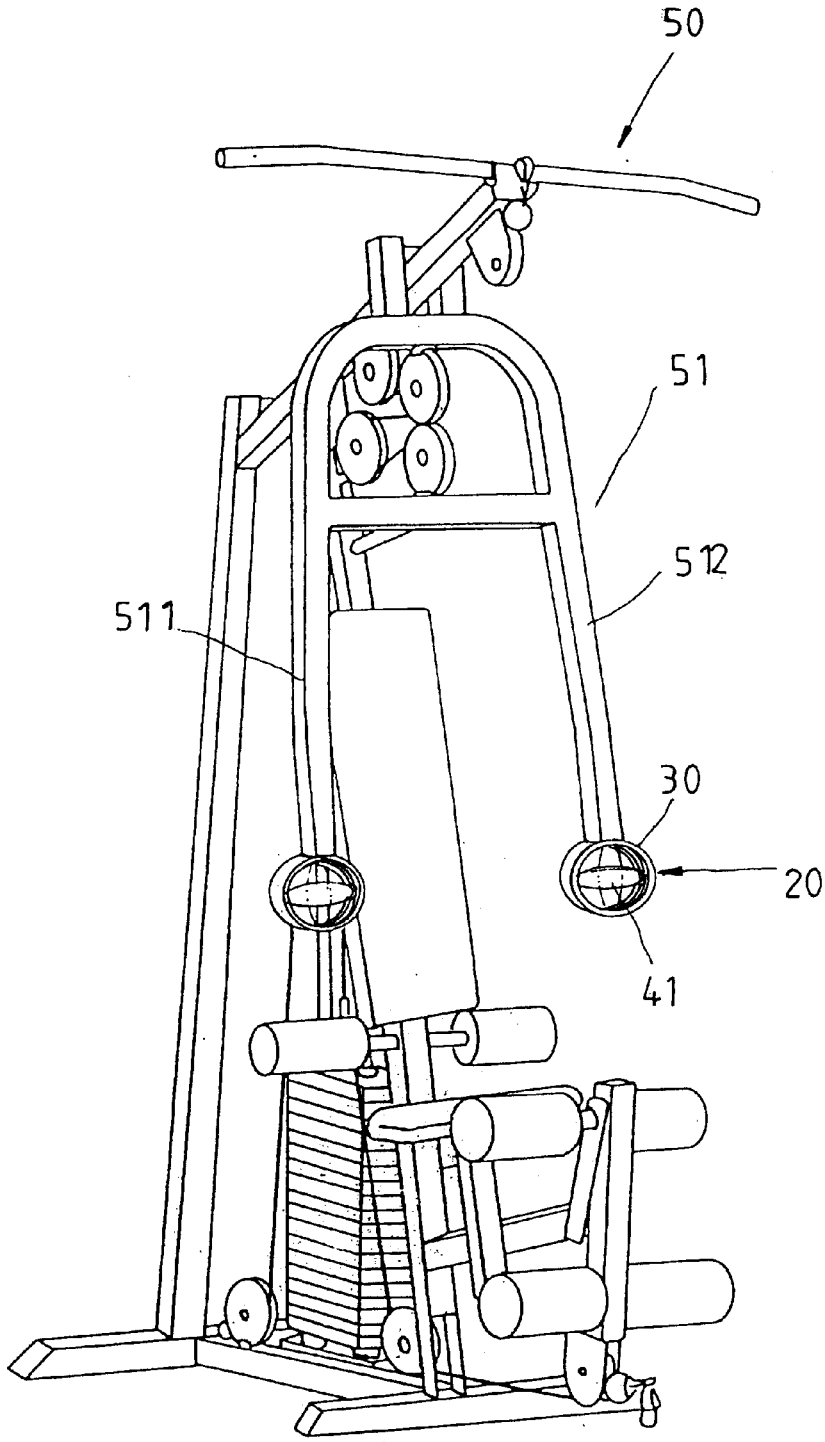
FIG. 5 shows a schematic view of the preferred embodiment of the present invention in use.

The grip structure 20 of the present invention is applicable to a variety of exercise devices, as shown in FIG. 5. The grip structure 20 is disposed on a multifunctional exercise device 50 such that the main body 30 is fastened with the ends of two operation rods 511 and 512 of the push-lift mechanism 51, and that the through hole 34 of the main body 30 is located under or in the inner side of the main body 30 for receiving the bolt elements 44 and 45. The grip member 40 located in the groove 33 of the main body 30 can be rotated for an angle of 360 degrees in relation to the main body 30. As a result, the grip rod 41 can be so rotated that the grip rod 41 is perpendicular to the longitudinal direction of the operation rod 51, and that the grip rod 41 is in a horizontal state. The user may hold horizontally the grip rod 41 such that palms of both hands face outwards, and that both fists are opposite to each other, thereby enabling the user to push the operation rods 511 and 512 up and down. In addition, the grip rod 41 may be so rotated that the grip rod 41 is in a vertical state, thereby enabling the user to push the operation rods 511 and 512 up and down, with palms of both hands of the user being opposite to each other, and with fists facing rearwards. As a result, muscles of various parts of the user's body are trained.

Figure 6:
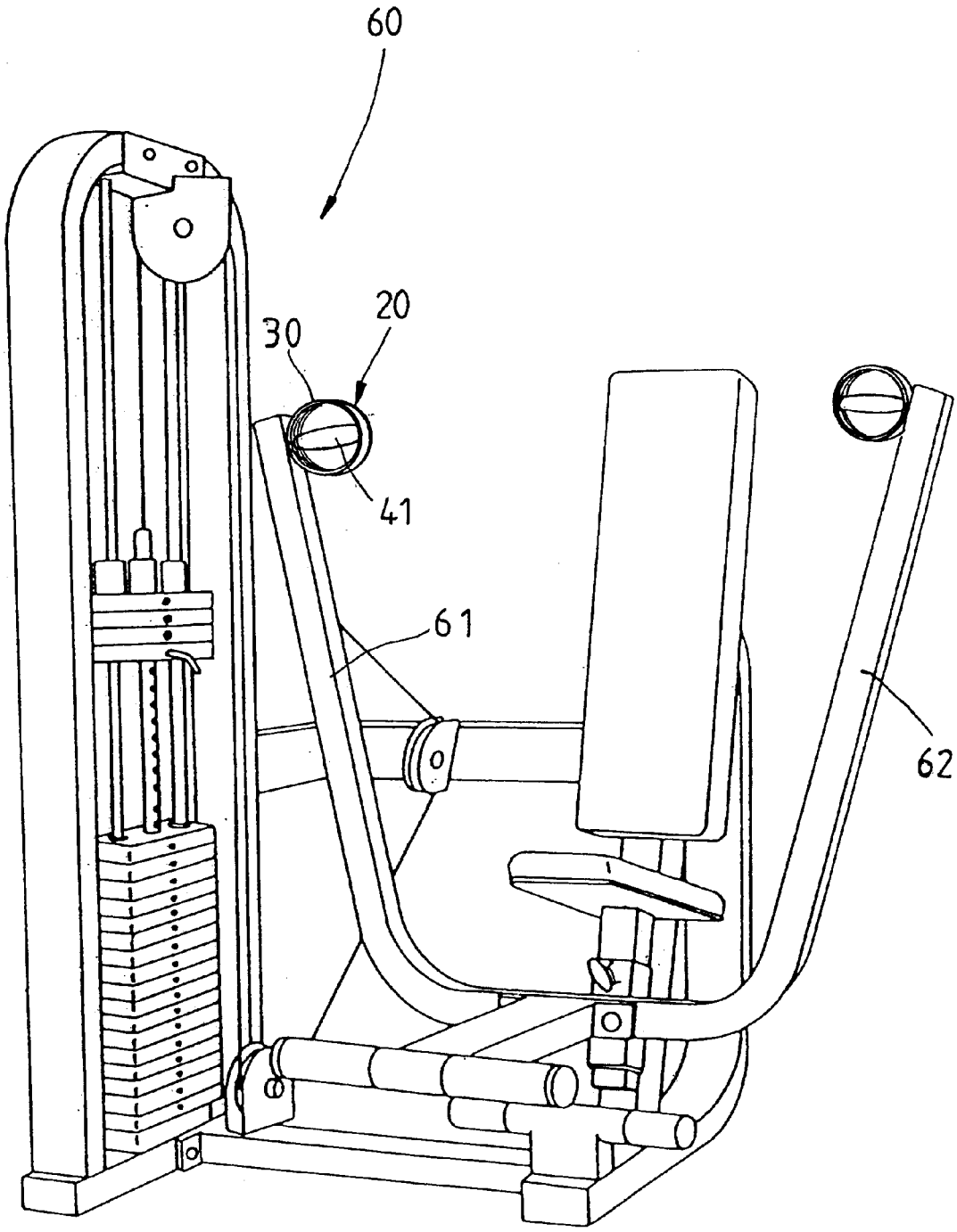
FIG. 6 shows another schematic view of the preferred embodiment of the present invention in use.

As shown in FIG. 6, the grip structure 20 of the present invention is disposed on a butterfly machine 60 such that the main body 30 is fastened with two opposite inner sides of two operation rods 61 and 62. The grip member 40 is adjusted 360 degrees in relation to the main body 30, so as to enable the user to change the direction in which the grip rod 41 is held fast. The user can choose a desired manner to grip the grip rod 41 to engage in an exercise. The exercise machine can be used in various manners to train the muscles of various parts of the user's body.

What is claimed is:

1. A grip structure adapted for connection to an operation rod of an exercise device, said grip structure comprising:

a main body being of a ring-shaped construction and having an outer ring portion, an inner ring portion, and a groove extending along said inner ring portion; and a grip member comprising a grip rod and two slide blocks disposed at two ends of said grip rod, said grip rod being held fast by an exerciser, said slide blocks being slidably received in said groove of said main body, wherein each of said slide blocks has a circular stop portion, said stop portion having a greater diameter than the width of said groove and corresponding in radian to said inner ring portion of said main body;

said grip member capable of being adjusted 360 degrees in said main body to facilitate the gripping of said grip rod by an exerciser in an optimal manner.

2. The grip structure as defined in claim 1, wherein said main body has a through hole extending from said outer ring portion to be in communication with said groove via said inner ring portion; wherein said grip rod is provided at two ends thereof with an inner threaded hole; wherein said two slide blocks are provided with a threaded hole; wherein said two slide blocks are fastened with said grip rod by two bolt elements which are engaged with said threaded holes of said slide blocks and said inner threaded holes of said grip rod via said through hole.

3. The grip structure as defined in claim 1, wherein each of said slide blocks is of an inverted T-shaped body and, said stop portion being a round disk body, said slide portion being a round columnar body extending from the center of said stop portion and having a diameter corresponding to the width of said groove of said main body, thereby enabling said slide portion to be slidably received in said groove.

4. The grip structure as defined in claim 3, wherein each of said slide blocks is provided in the bottom of said circular stop portion thereof with an inner recess hole having a diameter which is corresponding to the diameter of said grip rod for connecting said grip rod.

* * * * *